US012366085B2

(12) United States Patent
Hanley et al.

(10) Patent No.: US 12,366,085 B2
(45) **Date of Patent: *Jul. 22, 2025**

(54) HOVERING AIR FORT

(71) Applicants: Luciana E. Hanley, Rancho Santa Fe, CA (US); Edward E. Hanley, Rancho Santa Fe, CA (US)

(72) Inventors: Luciana E. Hanley, Rancho Santa Fe, CA (US); Edward E. Hanley, Rancho Santa Fe, CA (US)

( * ) Notice: Subject to any disclaimer, the term of this patent is extended or adjusted under 35 U.S.C. 154(b) by 169 days.

This patent is subject to a terminal disclaimer.

(21) Appl. No.: 17/751,384

(22) Filed: May 23, 2022

(65) Prior Publication Data

US 2022/0282516 A1 Sep. 8, 2022

Related U.S. Application Data

(63) Continuation-in-part of application No. 16/812,331, filed on Mar. 8, 2020, now Pat. No. 11,318,393, (Continued)

(51) Int. Cl.

| | |
|---|---|
| ***E04H 15/40*** | (2006.01) |
| ***A63H 33/00*** | (2006.01) |
| ***E04H 15/00*** | (2006.01) |
| ***E04H 15/22*** | (2006.01) |
| *E04H 15/20* | (2006.01) |

(52) U.S. Cl.

CPC ..... *E04H 15/22* (2013.01); *A63H 33/008* (2013.01); *E04H 15/006* (2013.01); *E04H 2015/206* (2013.01)

(58) Field of Classification Search

CPC ..... E04H 15/006; E04H 15/22; Y10S 52/13

See application file for complete search history.

(56) References Cited

U.S. PATENT DOCUMENTS 3,801,093 A * 4/1974 Jones, III ..... E04H 15/22 472/94

3,839,832 A * 10/1974 Kastner ..... E04H 15/22 52/2.14

(Continued)

OTHER PUBLICATIONS

"Rember fun filled fantasies in fan filled forts?" Lindstrom Dec. 6, 2012 (webpage) <https://www.kickstarter.com/projects/1353512235/remember-fun-filled-fantasies-in-fan-filled-forts>.

(Continued)

*Primary Examiner* — Chi Q Nguyen

(74) *Attorney, Agent, or Firm* — Woodard, Emhardt, Henry, Reeves & Wagner, LLP; William A. McKenna

(57) ABSTRACT

A hovering air fort containing an inflatable housing having an open base defined by a periphery surrounding the opening, one or more apertures, wherein one of the apertures is for receiving air flow for inflation and wherein the other aperture is for connecting a second hovering air fort and a cord hemmed into the periphery of the open base forming a hemmed opening or at least one connecting panel is affixed to at least two side walls about the open base periphery of the inflatable air fort, wherein the air flow through the aperture provides structure and lift for the inflatable housing when the periphery of the open base is positioned against an external surface to create the hovering air fort.

20 Claims, 2 Drawing Sheets

Related U.S. Application Data which is a continuation-in-part of application No. 16/794,167, filed on Feb. 18, 2020, now abandoned, which is a continuation-in-part of application No. 15/750,225, filed as application No. PCT/US2016/045926 on Aug. 6, 2016, now Pat. No. 10,619,375.

(60) Provisional application No. 62/201,987, filed on Aug. 6, 2015.

(56) References Cited

U.S. PATENT DOCUMENTS

| | | | | |
|---|---|---|---|---|
| 3,862,876 | A | 1/1975 | Graves et al. | |
| 4,164,829 | A | 8/1979 | Sadler | |
| 4,634,818 | A | 1/1987 | Greer et al. | |
| 5,484,335 | A * | 1/1996 | Holmberg | F24F 7/02 454/273 |
| 5,636,478 | A | 6/1997 | Chen | |
| 5,970,661 | A * | 10/1999 | Bishop | E04H 15/006 52/63 |
| 6,266,927 | B1 | 7/2001 | Leslie | |
| 6,363,551 | B1 | 4/2002 | Flores et al. | |
| D667,912 | S | 9/2012 | O'Neil | |
| 9,901,840 | B2 | 2/2018 | Hollowell et al. | |
| 10,024,562 | B2 * | 7/2018 | Chelf | A01G 9/1407 |
| 10,287,795 | B2 * | 5/2019 | Fraioli, Sr. | E04H 15/20 |
| 10,619,375 | B2 * | 4/2020 | Hanley | E04H 15/006 |
| 11,318,393 | B2 * | 5/2022 | Hanley | A63H 33/008 |
| 11,408,165 | B2 * | 8/2022 | Kolisnek | E04B 1/34321 |
| 2002/0162584 | A1 | 11/2002 | Berman | |
| 2006/0285836 | A1 | 12/2006 | Coppola | |
| 2017/0058553 | A1 * | 3/2017 | Day | E04H 15/02 |
| 2017/0081867 | A1 * | 3/2017 | Wasson | E04H 15/02 |
| 2017/0156961 | A1 * | 6/2017 | Patel | E04H 1/1205 |
| 2022/0282516 | A1 * | 9/2022 | Hanley | A63G 31/12 |

OTHER PUBLICATIONS

"Air Fort in Action" (Air Fort) Sep. 9, 2016 (Sep. 9, 2015) (video) accessed Feb. 16, 2017 at <http://youtu.be/q18cz2Qwfzo>.

"Air Fort" (Air Fort) Jan. 8, 2016 (Jan. 8, 2016) [webpage] accessed Feb. 16, 2017 at <http://web.archive.org/web/20160108165436/http://www.myairfort.com/>.

* cited by examiner

HOVERING AIR FORT

CROSS-REFERENCE TO RELATED APPLICATIONS

This application claims priority to: U.S. patent application Ser. No. 16/812,331 filed Mar. 8, 2020, now U.S. Pat. No. 11,318,393; U.S. patent application Ser. No. 16/794,167 filed Feb. 18, 2020; U.S. patent application Ser. No. 15/750,225 filed Jun. 6, 2018; PCT patent application Ser. No. PCT/US16/45926 filed Aug. 6, 2016; and Provisional Application Ser. No. 62/201,987, filed on Aug. 6, 2015, all of which are incorporated herein in their respective entirety by this reference.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

The present invention relates generally to play structures for adults or children. More specifically, a hovering play structure with no base that maintains its configuration by the flow of air directed into the structure by a device such as a household fan.

BACKGROUND OF THE INVENTION

Most children have built forts that are places specifically for themselves in which to play. These structures, in their simplest form, are made of household furniture with cloth coverings such as blankets and sheets draped over the furniture to create the enclosure. More elaborate structures are constructed of building materials and may be constructed to resemble small homes with foundations on the ground or in some cases in living trees. Similar structures, made of collapsible panels, are described in U.S. Pat. Nos. 5,313,747 and 5,706,613. Another structural configuration is that of an igloo is disclosed in U.S. Pat. No. 5,715,854. In addition, structures made of inflatable elements have also been disclosed. In U.S. Pat. No. 5,145,440 a cabin is constructed of inflatable interlocking simulated logs. Similarly U.S. Pat. No. 5,273,477 describes inflatable blocks with interlocking tongue and groove that may be stacked to create a structure.

Another structure described in U.S. Pat. No. 5,970,661 describes and inflatable tent constructed of air permeable fabric with a shroud on one end to receive a household fan and a plurality of anchor weights along the perimeter edge that may be adjusted to create different shaped configurations of the tent. These weights are of sufficient weight to secure the structure on a flat surface while maintaining the desired configuration of the structure. They are inserted into cylindrical pockets formed at the free edges of the middle and side panels. Children enter and exit the structure by lifting an edge and climbing under it. Unfortunately, this invention can be difficult for a child to enter or exit depending on the location of the weights, potential shifting of the weights in their cylindrical pockets or relocation of the weights will change the desired shape of the structure and, as a whole, the inflated structure cannot be moved or relocated easily on a flat surface when in use without moving each of the weights or deflating the structure.

Consequently, there is a need for an inflatable structure that is easily entered from all locations along the perimeter edge of the structure that maintains its desired shape and can be easily moved or rotated on a flat surface when fully inflated.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of a hovering air fort. The present hovering air fort comprises an inflatable housing having side walls and an open base defined by a periphery surrounding the opening and an aperture for receiving air flow for inflation. The inflatable housing periphery base contains at least one connecting panel affixed to at least two of the inflatable housing side walls about the periphery base. The at least one connecting panel does not cover a majority of the open base so that air flow through the aperture provides structure and lift for the inflatable housing when the open base is positioned over an external surface thereby creating the hovering air fort.

In another configuration the present invention is an air fort that comprises an inflatable housing having an open base defined by a periphery surrounding the opening and an aperture for receiving air flow for inflation. A cord is hemmed into the periphery of the open base forming a hemmed opening so that air flow through the aperture provides structure and lift for the inflatable housing when the hemmed opening is positioned against an external surface to create the hovering air fort.

In this aspect of the present invention, the means for continuously forcing air may include a fan and a shroud engaged between the fan and the aperture to establish a channel for air flow for forcing air with the fan or other similar device from outside the inflatable housing and through the aperture to over pressure air inside the inflatable housing.

In one embodiment of this aspect of the invention, the first end of the shroud may be secured to inflatable housing by stitching, snaps, a zipper, or Velcro™. In addition, the second end of the shroud may further comprise snaps, a cinch cord, straps or Velcro™ to secure a fan to the hovering air fort. Further, the cord may be secured at the bottom peripheral edge of the opening of the inflatable housing by stitching or Velcro™.

In another embodiment the inflatable housing of the hovering air fort may further comprises a viewing port. The viewing port may be made of transparent fine mesh netting that provides resistance to escaping air from the fort and does not affect maintaining its inflation. Alternatively, this viewing port may be covered with a translucent polymer sheet that allows others outside of the inflatable air fort to see those inside.

In another embodiment of the present invention, the inflatable housing may be provided in the shape of a building, a vehicle, an animal, an element of nature of some other object such as a Crayon™.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures and systems for carrying out the several purposes of the present disclosed device. It is important, therefore, that the claims be regarded as including such equivalent construction and methodology insofar as they do not depart from the spirit and scope of the present invention.

The objects, features, and advantages of the invention will be brought out in the following part of the specification, wherein detailed description is for the purpose of fully disclosing the invention without placing limitations thereon.

DETAILED DESCRIPTION OF THE INVENTION

Figure 1:
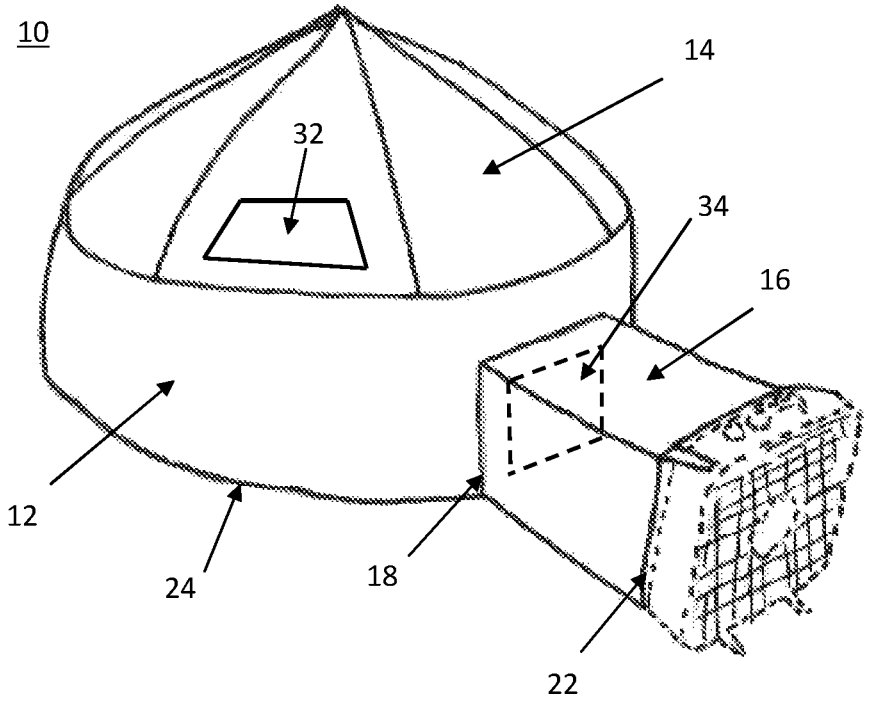
FIG. 1 shows a perspective view of one inflated hovering air fort configuration of the present invention.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The terms "joined" or "affixed" as used herein refers to the connecting of one or more panels of material that make up the inflatable housing of the present invention. This term includes stitching, fusing temperature sensitive material through heat and/or the use of an adhesive. These are just a few methods of fastening one or more pieces of fabric, cloth or textile to one another and will include other methods known to those skilled in the art.

The term "secured" as used herein refers to the affixing of the shroud over the aperture within the inflatable housing. This term includes stitching, fusing temperature sensitive material through heat, the use of an adhesive, a zipper and/or Velcro™. These are just a few methods of affixing the shroud to the inflatable housing and will include other methods known to those skilled in the art.

The term "hole" and/or "aperture" are used synonymously to refer to an opening provided in the side of the hovering air fort to channel air flow from the means for forcing air into the structure. This hole or aperture may be provided in a variety of sizes that allows sufficient fluid communication with the air fort to allow the structure to hover over a surface on which it is inflated.

The term "hover", "hovers", or "hovering" as used herein refers to the ability for the present invention to be inflated over a surface and remain positioned over that surface with no or minimal contact with the surface itself. In essence, the air fort is raised above the surface resulting from the air escaping the bottom edge of the structure uniformly. This unique construction allows the air fort to be easily moved over the surface by turning or lifting and relocating the means for forcing air (e.g., a fan).

The term "inflatable housing" as used herein refers to a structure having any variety of shapes that may be appealing to children with an aperture for receiving air flow to inflate the housing and open base. A cord is hemmed into the periphery edge of the open base having a weight that allows the bottom edge of the open base to be lifted above the surface when the fan forces air into the inflatable housing of the hovering air fort.

The term "vehicle" as used herein refers to any device used to transport a thing from one place to another, for example a car which utilizes tires to mobilize the vehicle on a solid surface, a train which utilizes wheels to mobilize the vehicle on prepositioned rails, a boat which utilizes a propeller or pressurized fluid to mobile the vehicle on water or a space craft which utilizes expansive chemical fuels to mobilize the vehicle though air and space.

The term "cord" as used herein refers to any device used along the periphery of the open base of the hovering air fort to maintain the walls and/or side walls of the air fort taught but does not prevent air from escaping the bottom edge of the open base of the air fort. The cord may be made of a variety of solid linearly uniform materials such as rope, cable, a flexible tube or chain constructed from natural fibers such as hemp, cotton or fabric, polymer such as nylon, polyester or plastic, metal or wood. It may also include these same linearly uniform materials that are hollow and may be filled with sand, small spherical high-density polymer, glass, stone or metal beads or pebbles or any other similar materials that may be inserted into a hollow structure to provide additional weight to these hollow linearly uniform materials.

The term "closable aperture" as used herein refers to at least one opening or aperture in the side wall of the air fort to which a passageway or tunnel may be connected to join two or more inflatable air forts. The aperture will have either a connected or removable panel secured over the opening or aperture by a securing means such as a zipper, Velcro™ or other similar means known to those skilled in the art. The panel is either removed from the air fort or folded up or over to one side and secured providing access to the securing means for connecting the passageway or tunnel to the next air fort. The closable aperture may also be utilized as a door. In this configuration, the securing means is provided on the exterior side of one or more of the air fort sidewalls at a distance beyond the perimeter edge of the closable aperture allowing the passageway or tunnel to be secured to the air fort without obstructing the closable aperture. More specifically, the closable aperture may be opened and or closed from the inside to allow access to the passageway or tunnel as desired.

The term "item of nature" as used herein refers to any item of nature that has not been altered or modified by human effort such as a boulder, a mountain, a stalagmite or similar non-living item. This also includes living items such as a tree, a piece of fruit, a vegetable or similar non-animal item.

The term "animal" as used herein refers to any animal whether fanciful, cartoon or natural such as for example, a dragon, Sponge Bob™, or a whale. Fanciful species includes non-cartoon animals created by man such as a dragon, unicorn, centaur, flying horse, cyclops and the like. A cartoon species include creatures like Sponge Bob, Mickey Mouse, Stitch, or similar creature. A natural animal includes naturally occurring species such as mammal species, bird species, fish species, mollusk species, reptile species, amphibian species or other species.

The present invention is a hovering air fort that can be constructed in a variety of configurations. In general the hovering air fort is an inflatable housing having an open base defined by a periphery surrounding the opening and an aperture for receiving air flow for inflation. The inflatable housing periphery base contains at least one connecting panel affixed to at least two of the inflatable housing side walls about the periphery base. The at least one connecting panel does not cover a majority of the open base so that air flow through the aperture provides structure and lift for the inflatable housing when the open base is positioned over an external surface thereby creating the hovering air fort. Because the inflatable housing can be provided in any shape or configuration, the appearance of the present invention is only limited by the imagination of one skilled in the art. The construction of the invention that allows the hovering fort to "hover" over the surface on which it is erected is one of the unique aspects and separates this fort from all others.

In another configuration, the hovering air fort is an inflatable housing having an open base defined by a periphery surrounding the opening and an aperture for receiving air flow for inflation; a cord hemmed into the periphery of the open base forming a hemmed opening; wherein said air flow through said aperture provides structure and lift for the housing when the hemmed opening is positioned against an external surface to create the hovering air fort.

Two other simple configurations of the many in which the hovering fort may be constructed include a rectangular or square structure and a circular or round structure. In the first exemplary configuration, the air fort comprises an inflatable housing having a front panel formed with a hole and having two opposite edges of a height H and two opposite edges of a width a rear panel having two opposite edges of the height H and two opposite edges of a length W; a first side panel having two opposite edges of height H and two opposite edges of length L; a second side panel having two opposite edges of the height H and two opposite edges of the length L; a top panel having two opposite edges of the width W and two opposite edges of the length L, wherein the two opposite edges of width W of the top panel are each respectively joined to an edge of the width W on the front panel and to an edge of the width W on the rear panel, and wherein the two opposite edges of length L of the top panel are each respectively joined to an edge of the length L on the first side panel and to an edge of the length L on the second panel, and further wherein the front panel is positioned between and is joined to the first side panel and to the second side panel at respective edges of height H, and the rear panel is positioned between and is joined to the first side panel and to the second side panel at respective edges of height H, to form an unstructured cover having an opening defined by a periphery surrounding the opening; a cord hemmed into the cover at the periphery of the opening around the opening; and a means for continuously forcing air through the hole in the front panel to provide structure and lift for the cover when the hemmed opening is positioned against an external surface to create the air fort. Air flow for inflating the air fort can be provided by a fan and a shroud engaged between the fan and the hole in the front panel to establish a channel for air flow for forcing air with the fan from outside the cover and through the hole in the front panel to over pressure air inside the structure cover.

Figure 2:
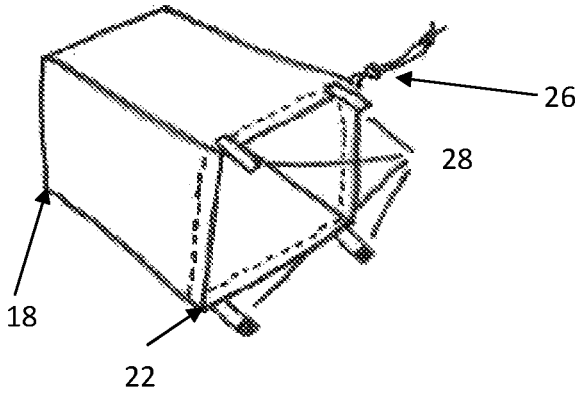
FIG. 2 shows a perspective view of the shroud for connecting the hovering air fort in fluid communication with a fan or other source of air that may be used to inflate the hovering air fort.
Figure 3:
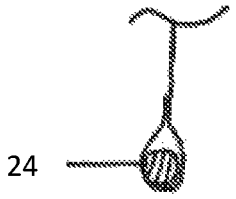
FIG. 3 shows a cross sectional view of a cord secured along the peripheral edge of the open base of the hovering air forts inflatable housing.
Figure 4:
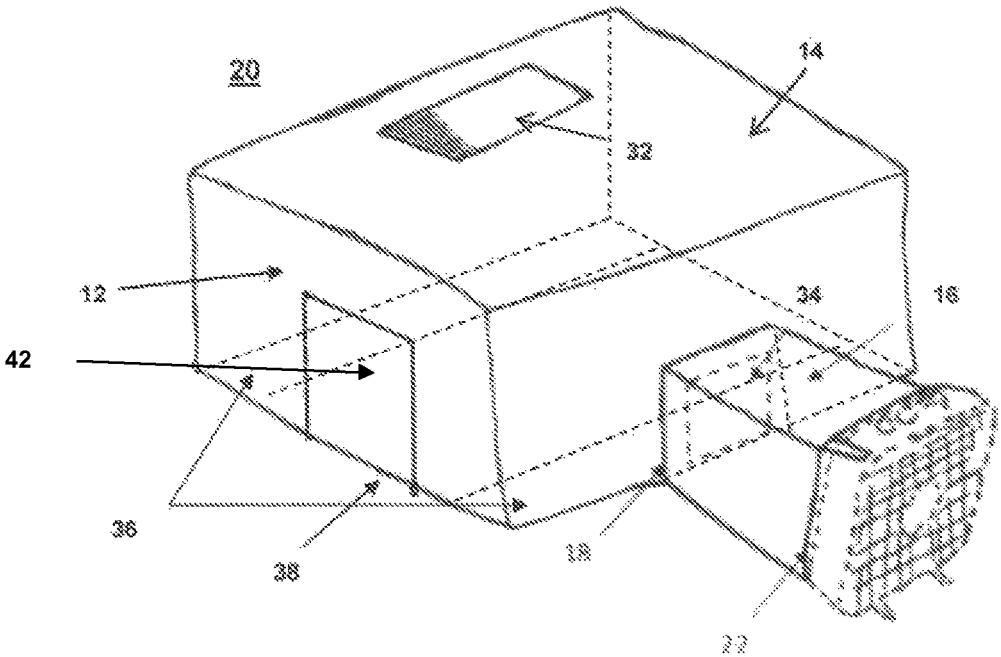
FIG. 4 shows a perspective view of a rectangular hovering air fort 20 of the present invention in its inflated configuration with two connecting panels.
Figure 5:
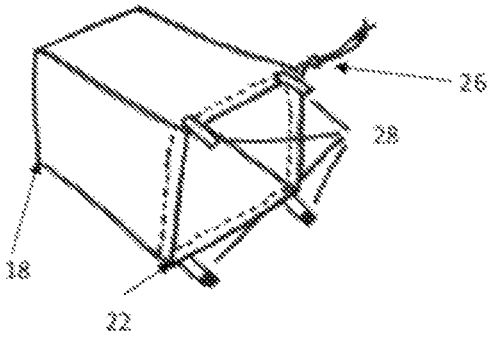
FIG. 5 shows a perspective view of the shroud for connecting the hovering air fort in fluid communication with a fan or other source of air that may be used to inflate the hovering air fort of FIG. 4.

In the other exemplary configuration the hovering air fort comprises a circular side panel (FIGS. 1-3) having a an aperture, a top edge and a bottom edge; a domed top panel having a peripheral edge, the peripheral edge joined to the top edge of the circular panel; a shroud having a first end secured to the circular side panel to provide an air flow channel for forcing air through the aperture and a second end for receiving a fan; and a single cord secured at the bottom edge of the circular side panel, wherein the cord is secured along about 75% to 100% of the bottom edge of the circular side panel, the cord having a weight that allows said bottom edge to be lifted above the surface when the fan forces air into the air fort.

Other recognizable structural configurations are within the scope of those skilled in the art that would be readily recognized by the user. The configuration of the inflatable housing is only limited by ones imagination. For example, the inflatable housing may be provided in the shape of a building or structure (e.g., a castle, a house, a barn, a silo, a skyscraper, a bridge or other similar building or structure), a vehicle (e.g., a race car, a ship, a train, a space ship or other vehicle), an animal (e.g., real or fanciful, a dragon, a whale, a turtle or other animal), an element of nature (e.g., a boulder, a tree, a mountain or other item of nature), or an item that is known to the user such as a Crayon™, a box or other household item to name a few. More specifically, the present invention is not limited by the inflatable housing's shape and one skilled in the art could easily modify the design of these and other shapes to assure that all structural elements that define these shapes fully inflate during use.

I. Inflatable Housing

The panels that make up the inflatable housing are made of a light weight material or fabric and form the ceiling and side walls of the hovering air fort 10. The fabric selected allows for the passage of air so that an individual can breathe without difficult through the fabric in the event that air flow from the fan fails and the fabric settles on the surface. The fabric that may be utilized with the present invention can be determined by those skilled in the art. Preferably, if a person can breathe, without difficulty, through at least three layers of the fabric then the fabric is sufficiently permeable and suitable for use. In one embodiment, the fabric utilized is a polyester fabric having 190 thread count (190T) and 70 Denier (70D) which is a measure of the linear mass density of the material used to construct the fabric. Other materials known to those skilled in the art may be utilized that provide similar thread count and Denier ratings.

The hovering air fort may be provided in a variety of configurations. In the first exemplary configuration described above the fort is rectangular in shape 20 and in the second it is cylindrical 10. In either configuration the panels may comprise one or more translucent panels or viewing ports 32 (i.e., windows) made of a fine mesh netting that maintains resistance to air flow that has no or minimal effect on the ability to inflate or maintain the structure in its inflated form. One skilled in the art can determine what netting materials would be suitable for this purpose by measuring their air permeability and compare that to the material used for the panels or by incorporating the translucent panels into the structure and testing for inflation and maintaining inflation during use. Other materials such as fabric known as organza that has high air permeability may also be used in place of netting. These viewing ports may also be made of a translucent polymer that allows those outside of the fort to view individuals inside. The polymer selected is pliable and resistant to cracking or tearing during continued use. Particular types and gauges of clear polymer sheeting used for similar structures are known to those skilled in the art or can be tested to determine which gauge and clarity of polymer sheeting would be best suited for this purpose.

A hole or aperture 34 is provided in the inflatable housing 12 to provide an opening through which air can be forced to inflate the structure. This hole or aperture 34 should be of a diameter or size that allows a sufficient volume of air to be forced into the structure maintaining its configuration and raising the base just above the surface during use. In one embodiment, the hovering air fort 10 is inflated using a 20 inch box fan having an air flow of 3.3 cubic feet per second on the low setting, 4.6 cubic feet per second on medium and 6.0 cubic feet per second on high. The hole or aperture 34 utilized with this type of fan is about the same width and height of the fan.

The hole or aperture 34 may be covered with an open netting or mesh that does not significantly restrict air flow but does prevent an individual from reaching a hand or other object into or near the fan.

The bottom edge of the inflatable housing 12 may provide a method for incorporating a cord 24, which provides tension to keep the walls of the fort 10 relatively taught yet allow the bottom edge to be lifted above the surface when air is forced into the structure. More specifically, the cord 24 does not provide weight that anchors the sides of the structure to the ground preventing easy movement of the entire structure simultaneously. The weight is merely enough to keep the wall taught and allow air to escape along the entire bottom edge preventing the bottom edge from contacting the ground. This method may include a sleeve along about 75% to 100% of the bottom edge in which the cord 24 can be inserted and housed, a series of snaps or Velcro™ along the bottom that can be folded over the cord 24 and secured maintaining the cord 24 in the sleeve it creates, or the cord 24 can be sewn into the bottom edge of the panels.

In an alternative configuration, the inflatable housing periphery base contains at least one connecting panel 36 affixed to at least two of the inflatable housing sidewalls 12 about the periphery base 38. The at least one connecting panel 36 does not cover a majority of the open base so that air flow through the aperture 34 provides structure and lift for the inflatable housing 20 when the open base is positioned over an external surface thereby creating the hovering air fort. For example, if the sidewalls 12 of the inflatable housing are in the shape of a rectangle, then one connecting panel 36 could be provided in the shape of an elongated rectangle with one of its longest sides connected along the base of one of the shorter sidewalls 12 of the inflatable housing and its two shorter sides connected to the base of the two longer sidewalls 12 of the inflatable housing. This can provide additional structural support for the inflatable housing 20. Alternatively, the connecting panel 36 could be provided in the shape of a triangle, connecting two sidewalls 12 of the inflatable housing with one side of the triangular panel attached to a portion of the base of one sidewall 12 of the inflatable housing and a second side of the triangle attached to a portion of the base of an adjoining sidewall 12 of the inflatable housing 20. This type of connection can be provided with a panel in the shape of a triangle with one of the apexes removed forming for example an isosceles trapezoid. In this configuration, the base corner of adjoining sidewalls 12 would then be open to air flow.

The side panel(s) of the inflatable housing may further comprise passageways or tubes with connecting means to allow one hovering air fort to be connected to another hovering air fort. This can be provided in a variety of configurations. The rear and/or side panels or the circular side panel of the exemplary configurations discussed above may comprise one or more closable openings to which the passageway(s) or tube(s) may be secured by each end to the two hovering air forts. These passageways or tubes can be separate from the hovering air forts with the passageways or tubes having connection means on each end, such as a zipper or Velcro™, for securing to the perimeter edges of the closable opening(s) 42. In one embodiment, the shroud of one hovering air fort may be used as a passageway or tube for connecting to a second hovering air fort. Alternatively, they may be secured to the closable opening(s) 42 on the hovering air fort by, for example, sewing or adhesive. In this configuration, they may be exposed on the exterior of the rear and/or side panels or the circular side panel or they may be housed within a pocket having cover formed in the exterior of the hovering air fort. In use, the cover is opened and the passageway or tube may be unfurled and ready for connecting to a second hovering air fort. Once connected the closable openings 42 are opened on both hovering air forts to allow for fluid connection between both forts.

II. Shroud

The shroud 16 may be made of the same or different material as the panels and preferably meets the same criteria, allowing a person to breath without difficulty through three layers of the material, as elaborated above for the selection of panel material. The shroud 16 has a first end 18 that affixes to the air fort and a second end 22 that affixes to a means for forcing air into the air fort 10. It may be provided in a variety of shapes including rectangular or circular and its size will depend on the diameter of the hole or aperture provided in the inflatable housing panel 12 respectively.

In one embodiment, the shroud 16 has the same configuration as the housing of a fan used to force air into the air fort. Correspondingly, the shroud 16 could be larger than the housing of a fan to allow a number of different fans to be used in inflating the air fort 10. In this configuration, the end of the shroud that affixes the fan to the air fort 22 may have connectors that allow it to be formed about the housing of the fan, such as a cinch cord 26, straps or Velcro™ 28. When using a cinch cord 26, the second end 22 may further comprise a small hood that envelopes the perimeter of the fan such that when the cinch cord 26 is drawn it overlaps the back of the fan and secures it within the shroud 16.

In another embodiment, the end of the shroud 16 that is affixed to the inflatable housing panel 12 may be connected by a variety of methods including stitching, snaps, a zipper or Velcro™. In addition, the first end 18, the second end 22 or both ends could further comprise an open mesh netting that does not significantly affect the air forced into the air fort 10 for inflation but prevents or interferes with reaching a hand or other object through the shroud 16 to the fan.

III. Cord

The cord 24 is a device used along the periphery of the open base of the hovering air fort to maintain the walls and/or side walls of the air fort taught but does not prevent air from escaping the bottom edge of the open base of the air fort. The cord may be a single piece or multiple pieces made of a variety of linearly uniform materials such as rope, cable, a flexible tube or chain secured along the perimeter edge of the base of the air fort. It may also include these same linearly uniform materials that are hollow and may be filled with sand, small spherical metal or high-density polymer beads, stone beads or pebbles or any other similar materials that may be inserted into a hollow structure to provide additional weight to these hollow linearly uniform materials. Such materials can be measured to determine their weight per linear foot and based on the size of the structure desire, the power of the air flow to be supplied, the number of cubic feet being forced into the structure, the total length of the bottom edge and the weight of the structure itself, one skilled in the art can prepare a generally linear graph of the weight required versus the cubic area of the air fort to determine the appropriately weighted cord 24 to use for a particular sized air fort 10. While this may take some routine experimentation one skilled in the art would be able to accomplish this determination without undue experimentation.

The cord 24 may be secured to the bottom edge of the air fort 10 by a variety of methods. These may include a sleeve along the bottom edge in which the cord 24 can be inserted and housed, a series of snaps or Velcro™ along the bottom edge that can be folded over the cord 24 to securely maintain the cord 24 in the sleeve created, or the cord 24 can be sewn into the bottom edge of the panel or panels. Further the cord 24 may be incorporated along the entire length of the bottom edge or just a portion. Preferably, the cord 24 is secured along about 75% to 100% of the bottom edge of the air fort.

IV. Air Forcing Means

The air forcing means may be any device that provides the desired cubic foot air flow to inflate an air fort 10 of a desired size maintaining the bottom edge just above the surface or ground. Popular air forcing means commercially available are fans, which come in a variety of shapes and sizes. While many of the fans can be adapted to provide the air flow desired for the present invention the common 20 inch box fan (Lasko 20 Inch Box Fan (B20200), Walmart Bentonville Ak., Holmes Box Fan 20" (HBF2002A-W), Target Minneapolis, MN, Air King 20" Box Fan (G3328682) Zoro, Inc., Buffalo Grove Ill.) with three settings is particularly easy to use. The low setting provides 3.3 cubic feet of air per second, the medium setting provides 4.6 cubic feet of air per second and the high setting provides 6.0 cubic feet of air per second.

V. Preparation

Table 1 contains information for the general construction parameters for preparing a variety of sizes of a hovering air fort of the configuration provided in FIG. 1.

TABLE 1[1]

| | | | | | |
|---|---|---|---|---|---|
| Fort Volume ($Ft^3$) | 60 | 80 | 100 | 200 | 275 |
| Fort Weight (Oz.) | 23 | 27 | 31 | 36 | 42 |
| Length of Perimeter Weighting (Ft) | 18.5 | 21.2 | 23 | 26.5 | 34 |
| Minimum Cord Weight for Vertical Stability (Oz) | 4.6 | 5.4 | 6.2 | 7.2 | 8.4 |
| Maximum Cord Weight for Mobile Hovering (Oz) | 6.9 | 8.1 | 9.3 | 10.8 | 12.6 |
| Fan Output($Ft^3$/sec) | 3.3 | 3.3 | 3.3 | 4.6 | 4.6 |
| Aperture Size 20" Box Fan (Inches) | 20" × 20" | 20" × 20" | 20" × 20" | 20" × 20" | 20" × 20" |
| Window Size (Inches)[2] | 26" × 12" | 26" × 12" | 26" × 12" | 26" × 12" | 26" × 12" |

[1]This chart is for a hovering air fort whose center of gravity does not exceed 50% of its height.
[2]Window size is for a permeable organza material.

VI. Use

The hovering air fort is maintained in a cinch bag, which is uncinched and the hovering air fort removed and laid flat on the floor. If the shroud is not attached the user affixes the shroud to the panel over the hole or aperture. The other end of the shroud is then affixed to a box fan in this example. Depending on the type of connectors the shroud may be secured by Velcro™ tabs, or a hood with a draw string cinch. Once the connections are secured and the fan is in place, the fan is activated and the air fort inflates. In one embodiment, the volume of the air fort is 60 cubic feet including the shroud volume and has a weight of 23 ounces including the cord. With a 20 inch box fan on the low setting the hovering air fort inflated in 18 seconds, on the medium setting it inflates in 13 seconds and on the high setting it inflates in 10 seconds. In this configuration, efficient hovering occurs when the cord weighting is distributed evenly along the bottom edge and is no less than 20% of the total weight of the air fort. Once the hovering air fort is inflated it may be moved to the desired location on the surface by grasping the handle on the top of the 20 inch box fan and shifting the fan to the appropriate location. The air fort will remain inflated, will move with the fan and readjust itself to its normal orientation with respect to the fan when the fan is stationary. Fine adjustment of the hovering air fort may be accomplished by merely turning the fan. The air fort will follow the fan movement and readjust itself to its normal orientation with respect to the fan during the movement or when the movement is completed. The balance between the perimeter weighting, the size of the air fort, the volume of air being forced into the fort and the weight of the panels that comprise the fort permit the fort to maintain stability and hover simultaneously.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A hovering air fort comprising:

an inflatable housing, said inflatable housing having side walls and an open base defined by a periphery surrounding said open base and at least two apertures, wherein one of said at least two apertures is for receiving air flow for inflation and the other of said at least two apertures is a closable aperture for connecting to another hovering air fort;

a cord hemmed into said periphery of said open base forming a hemmed opening; and wherein said air flow through said aperture for receiving air flow provides structure and lift for said inflatable housing thereby creating said hovering air fort.

2. The hovering air fort according to claim 1, further comprising:

a fan; and a shroud engaged between said fan and said aperture to establish a channel for air flow for forcing air with said fan from outside said inflatable housing and through said aperture to over pressure air inside said inflatable housing said shroud having a first end adjacent to said inflatable housing and a second end opposite said first end.

3. The hovering air fort according to claim 1, wherein said shroud is secured to said inflatable housing by stitching, snaps, a zipper, or Velcro™.

4. The hovering air fort according to claim 1, wherein said second end of said shroud comprises snaps, a cinch cord, or Velcro™ to secure said fan to said inflatable housing.

5. The hovering air fort according to claim 1, wherein said cord is secured at the bottom edge of said circular side panel by stitching or Velcro™.

6. The hovering air fort according to claim 1, further comprising a shape wherein said shape of said inflatable housing is that of a building, a vehicle, an animal or an item of nature.

7. The hovering air fort according to claim 1 wherein said cord is a rope, a cable, a flexible tube or a chain.

8. The hovering air fort according to claim 7 wherein said rope, cable, or flexible tube is a hollow rope, cable, or flexible tube and wherein said hollow rope, cable, or flexible tube is empty or filled with sand, high-density polymer, glass, stone or metal beads, stone pebbles or other weighted material.

9. A hovering air fort comprising:

an inflatable housing, said inflatable housing having side walls and an open base defined by a periphery surrounding said open base and at least two apertures, wherein one of said at least two apertures for receiving air flow for inflation and one of said at least two apertures is a closable aperture for connecting to another hovering air fort;

at least one connecting panel affixed to said inflatable housing open base periphery wherein said at least one connecting panel is affixed to at least two of said inflatable housing side walls about said open base periphery and wherein said at least one connecting panel does not cover a majority of the open base; and wherein said air flow through said aperture provides structure and lift for said inflatable housing thereby creating said hovering air fort.

10. The hovering air fort according to claim 9, further comprising:

a cord hemmed into said periphery of said open base forming a hemmed opening; and wherein said air flow through said aperture provides structure and lift for said inflatable housing when said open base is positioned over an external surface thereby creating said hovering air fort;

a fan; and a shroud engaged between said fan and said aperture to establish a channel for air flow for forcing air with said fan from outside said inflatable housing and through said aperture to over pressure air inside said inflatable housing said shroud having a first end adjacent to said inflatable housing and a second end opposite said first end.

11. The hovering air fort according to claim 9, wherein said shroud is secured to said inflatable housing by stitching, snaps, a zipper, or Velcro™.

12. The hovering air fort according to claim 9, wherein said second end of said shroud comprises snaps, a cinch cord, or Velcro" to secure said fan to said inflatable housing.

13. The hovering air fort according to claim 9, wherein said cord is secured at the bottom edge of said circular side panel by stitching or Velcro™.

14. The hovering air fort according to claim 9, further comprising a shape wherein said shape of said inflatable housing is that of a building, a vehicle, an animal or an item of nature.

15. A hovering air fort comprising:

an inflatable housing, said inflatable housing having side walls and an open base defined by a periphery surrounding said open base and at least one aperture, wherein said at least one aperture for receiving air flow for inflation;

at least one connecting panel affixed to said inflatable housing open base periphery and wherein said at least one connecting panel does not cover a majority of the open base; and wherein said air flow through said aperture provides structure and lift for said inflatable housing thereby creating said hovering air fort.

16. The hovering air fort according to claim 15, further comprising:

a fan; and a shroud engaged between said fan and said aperture to establish a channel for air flow for forcing air with said fan from outside said inflatable housing and through said aperture to over pressure air inside said inflatable housing said shroud having a first end adjacent to said inflatable housing and a second end opposite said first end.

17. The hovering air fort according to claim 15, further comprising: one or more weights hemmed into said periphery of said open base forming a hemmed opening, wherein said one or more weights allow said all or a portion of said periphery surrounding said open base to be lifted above a surface when air is forced into said hovering air fort through said at least one aperture.

18. The hovering air fort according to claim 15, further comprising: a second aperture, wherein said second aperture is for connecting said hovering air fort to a second hovering air fort.

19. The hovering air fort according to claim 18, wherein said one or more weights are one or more pieces of cord, one or more pieces of rope, one or more pieces of cable, one or more pieces of flexible tube or one or more pieces of chain.

20. The hovering air fort according to claim 19, wherein said one or more pieces of rope, one or more pieces of cable, or one or more pieces of flexible tube is prepared from a hollow rope, a hollow cable, or a hollow flexible tube and wherein said hollow rope, cable, or flexible tube is empty or filled with sand, high-density polymer, glass, stone or metal beads, stone pebbles or other weighted material.

* * * * *